US011286794B2

(12) United States Patent
Loebig

(10) Patent No.: US 11,286,794 B2
(45) Date of Patent: Mar. 29, 2022

(54) EROSION-RESISTANT COATING WITH PATTERNED LEADING EDGE

(71) Applicant: Rolls-Royce North American Technologies, Inc., Indianapolis, IN (US)

(72) Inventor: James Carl Loebig, Greenwood, IN (US)

(73) Assignee: ROLLS-ROYCE NORTH AMERICAN TECHNOLOGIES, INC., Indianapolis, IN (US)

( * ) Notice: Subject to any disclaimer, the term of this patent is extended or adjusted under 35 U.S.C. 154(b) by 155 days.

(21) Appl. No.: 16/717,831

(22) Filed: Dec. 17, 2019

(65) Prior Publication Data

US 2021/0180462 A1 Jun. 17, 2021

(51) Int. Cl.
*F01D 5/28* (2006.01)
*F01D 5/14* (2006.01)

(52) U.S. Cl.
CPC ..... *F01D 5/288* (2013.01); *F01D 5/141* (2013.01); *F05D 2220/32* (2013.01); *F05D 2230/313* (2013.01); *F05D 2240/127* (2013.01); *F05D 2250/183* (2013.01); *F05D 2250/184* (2013.01); *F05D 2250/711* (2013.01); *F05D 2250/712* (2013.01); *F05D 2300/10* (2013.01); *F05D 2300/20* (2013.01); *F05D 2300/611* (2013.01)

(58) Field of Classification Search
CPC ..... F01D 5/141; F01D 5/288; F05D 2230/31; F05D 2230/313; F05D 2240/127; F05D 2250/183; F05D 2250/184; F05D 2250/711; F05D 2250/712; F05D 2300/10; F05D 2300/20; F05D 2300/611; C23C 28/322
See application file for complete search history.

(56) References Cited

U.S. PATENT DOCUMENTS

| | | | | |
|---|---|---|---|---|
| 6,095,755 | A * | 8/2000 | Houston | F01D 5/288 416/241 R |
| 2011/0052406 | A1* | 3/2011 | Bruce | F01D 5/28 416/241 R |
| 2014/0272166 | A1* | 9/2014 | Shim | C23C 28/042 427/448 |
| 2014/0301861 | A1 | 10/2014 | Bruce et al. | |
| 2016/0333706 | A1* | 11/2016 | Uihlein | F01D 5/286 |
| 2018/0135439 | A1* | 5/2018 | Devore | F01D 25/08 |

* cited by examiner

*Primary Examiner* — Eldon T Brockman
*Assistant Examiner* — Danielle M. Christensen
(74) *Attorney, Agent, or Firm* — Shumaker & Sieffert, P.A.

(57) ABSTRACT

An airfoil of a gas turbine engine includes a leading edge and an opposed trailing edge defining a chord between the leading edge and the trailing edge, wherein the chord has a chord length. A concave surface is between the leading edge and the trailing edge, which includes a first portion proximal the leading edge of the airfoil and a second portion proximal the trailing edge of the airfoil, wherein the first portion of the concave surface includes about 10% to about 50% of the chord length. An erosion-resistant ceramic, cermet or intermetallic coating is on the second portion of the concave surface, which includes a coating leading edge pattern. The first portion of the concave surface is free of the erosion-resistant coating.

19 Claims, 6 Drawing Sheets

EROSION-RESISTANT COATING WITH PATTERNED LEADING EDGE

BACKGROUND

Hard, erosion-resistant ceramic, cermet and intermetallic coatings such as nitrides and carbides have been used to reduce impact or erosion damage on the metal surfaces of compressor airfoils in gas turbine engines. For example, portions of a turbine engine can include rotating airfoils (rotors, also sometimes referred to as blades), as well as static airfoils (stators, also sometimes referred to as vanes). The erosion-resistant ceramic, cermet and intermetallic coatings can be used on the edges or the pressure and suction flowpath surfaces, or both, of the airfoils to reduce damage caused by particles entrained in air or other fluids ingested by the turbine engine. Gas turbine engines are particularly prone to ingesting particulate matter when operated under certain conditions, such as, for example, in desert environments where repeated sand ingestion occurs.

Ingested particulates can cause erosion of the leading edge (LE) of a rotating or static airfoil. In addition to LE erosion, ingested particulates can cause airfoil thinning, trailing edge (TE) reduction, and blade tip (height) reduction. Erosion-resistant coatings can have a significant positive impact on reducing bladed thinning and TE erosion.

SUMMARY

In general, the present disclosure is directed to erosion-resistant coatings including an airflow-facing patterned leading edge that can reduce or substantially eliminate the negative aerodynamic effects of the forward-facing edges of an erosion-resistant coating on a surface of an airfoil. The patterned leading edge includes pattern elements shaped to create less flow separation aft of the leading edge of the erosion-resistant coating layer, compared to the flow separation resulting from air flow aft of a straight (un-patterned) preferential coating which begins aft of the leading edge.

In one aspect, the present disclosure is directed to an airfoil of a gas turbine engine, which includes a leading edge and an opposed trailing edge, defining a chord between the leading edge and the trailing edge, wherein the chord has a chord length; and a concave surface between the leading edge and the trailing edge, the concave surface including a first portion proximal the leading edge of the airfoil and a second portion proximal the trailing edge of the airfoil, the first portion of the concave surface including about 10% to about 50% of the chord length. An erosion-resistant coating is on the second portion of the concave surface, the erosion-resistant coating including a leading edge pattern, and wherein the first portion of the concave surface is free of the erosion-resistant coating.

In another aspect, the present disclosure is directed to a method of making an airfoil for a gas turbine engine, the airfoil including a leading edge and an opposed trailing edge, and a chord between the leading edge and the trailing edge, wherein the chord has a chord length; and a concave surface between the leading edge and the trailing edge, the concave surface including a first portion proximal the leading edge of the airfoil and a second portion proximal the trailing edge of the airfoil, the first portion of the concave surface including about 10% to about 50% of the chord length. The method includes forming an erosion-resistant coating on the second portion of the concave surface, the erosion-resistant coating including a leading edge pattern, and wherein the first portion of the concave surface is free of the erosion-resistant coating.

The details of one or more examples are set forth in the accompanying drawings and the description below. Other features, objects, and advantages will be apparent from the description and drawings, and from the claims.

BRIEF DESCRIPTION OF DRAWINGS

Like reference numerals in the figures indicate like elements.

DETAILED DESCRIPTION

In general, the present disclosure is directed to erosion-resistant ceramic, cermet and intermetallic coatings including an airflow-facing patterned leading edge that can reduce or substantially eliminate the negative aerodynamic effects of the forward-facing edges of an erosion-resistant coating on a surface of an airfoil. The patterned leading edge includes pattern elements shaped to create less turbulent air transitions aft of the leading edge of the erosion-resistant coating layer, compared to the turbulence resulting from air flow over a straight (un-patterned) leading edge.

Erosion-resistant coatings have insufficient erosion and impact resistance to maintain coating integrity at the airfoil LE. During turbine engine operation the erosion-resistant coating is removed from the LE and metal erosion of the LE ensues. If the erosion-resistant coating remains intact on the pressure and suction surfaces just off of the LE edge, this intact coating prevents erosion just off of the LE, and the LE erosion forms a blunt leading edge. The deformed LE can reduce aerodynamic performance, and in some cases the aerodynamic performance of the deformed part can be worse than the performance of an eroded blade with no erosion-resistant coating.

Erosion and performance data from both test stand and fielded engines indicates that compressors with coated blades lose aerodynamic performance faster in austere (sand laden) environments than compressors with no blade coating. This performance reduction occurs because the coatings cause LE blunting, even though the coatings provide significant protection from airfoil thinning and TE erosion.

To prevent premature LE blunting while reducing or preventing airfoil thinning and TE erosion, some airfoil designs include an uncoated LE that is free of an erosion-resistant coating. Some airfoil designs can further include an uncoated portion of the convex (suction) side of the airfoil aft (downstream) of the LE, or an uncoated concave (pressure) side of the airfoil that is fully or partially uncoated by the erosion-resistant coating.

Figure 1:
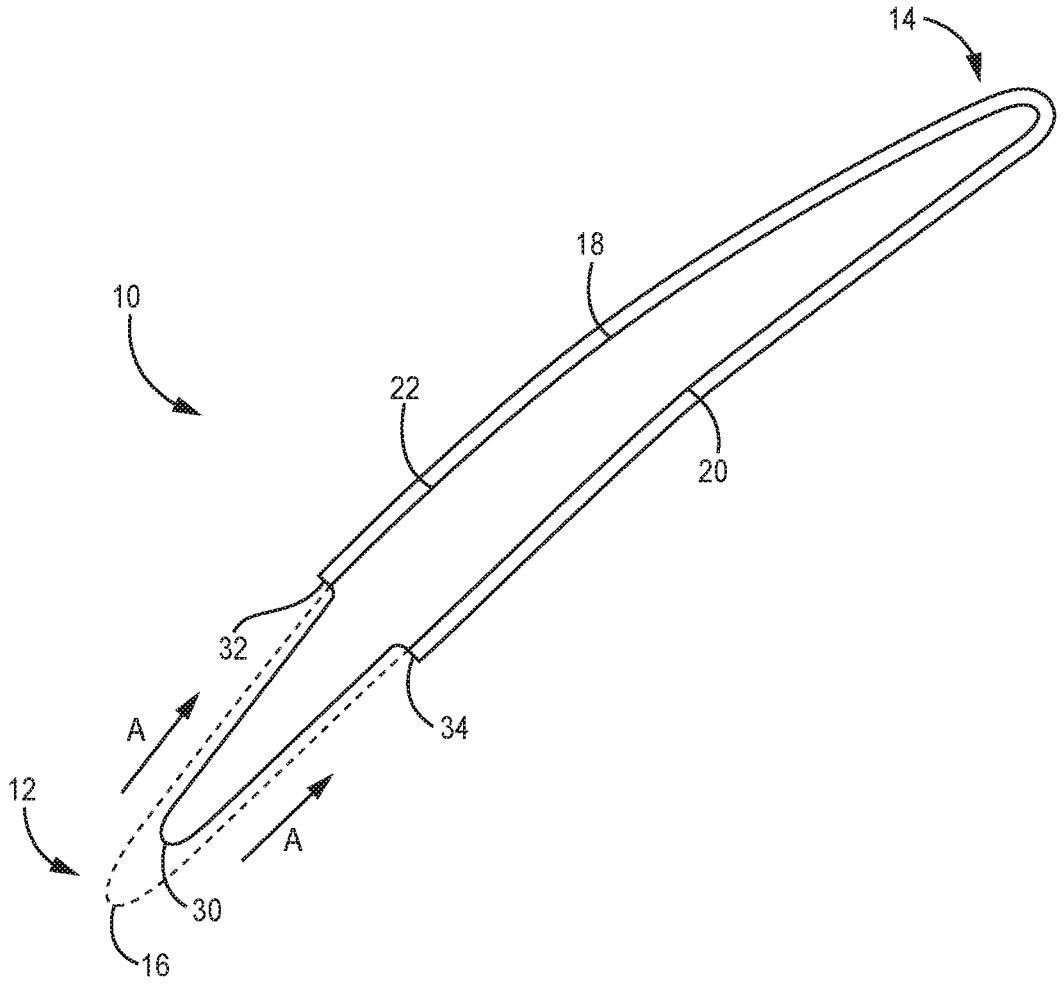
FIG. 1 is a schematic overhead view of an airfoil including an erosion-resistant coating.

Referring now to FIG. 1, an airfoil portion 10 includes a leading edge (LE) 12 and an opposed trailing edge (TE) 14.

An original as-fabricated nose 16 at the LE is free of an erosion-resistant coating, while portions of a convex surface 18 (suction side of the airfoil portion 10) and a concave surface 20 (pressure side of the airfoil portion 10) include an erosion-resistant coating 22, which also covers the TE 14. During turbine engine operation, as the as-fabricated nose 16 of the airfoil wears away from damage caused by high kinetic energy particle impacts at the LE 14, the nose 16 erodes to form an eroded nose 30. As the as-fabricated nose 16 wears away to form the eroded nose 30, the erosion-resistant coating 22 also gradually wears away, which forms steps 32, 34 in the coating on the convex surface 18 and concave surface 20, respectively. While not shown in FIG. 1, the size of the steps 32, 34 increases and moves toward the TE of the airfoil portion 10 as the LE of the airfoil 10 erodes. The steps 32, 34 interrupt the flow path from the LE to the TE of the airfoil 10 as fluids traverse the airfoil 10 in a flow direction A around the LE 12 and over the surfaces 18, 20.

When the airfoil portion 10 is in as-fabricated condition, the forward-facing steps 32, 34 are relatively small, so the impact of the erosion-resistant coating 22 on the aerodynamic performance of the airfoil 10 is relatively insignificant. However, as the nose 16 and the erosion-resistant coating 22 wear away, the steps 32, 34 become larger (e.g., due to quicker erosion of nose 16 compared to erosion-resistant coating 22), which can negatively impact aerodynamic performance of the airfoil portion 10. This negative aerodynamic impact can also result from forward-facing steps formed from thicker as-fabricated erosion-resistant coatings, even before LE erosion begins during austere turbine engine operation. In such cases, the larger forward facing edge steps 32, 34 of the eroded airfoil 10 can negatively impact aerodynamic performance regardless of the initial coating thickness.

Figure 2:
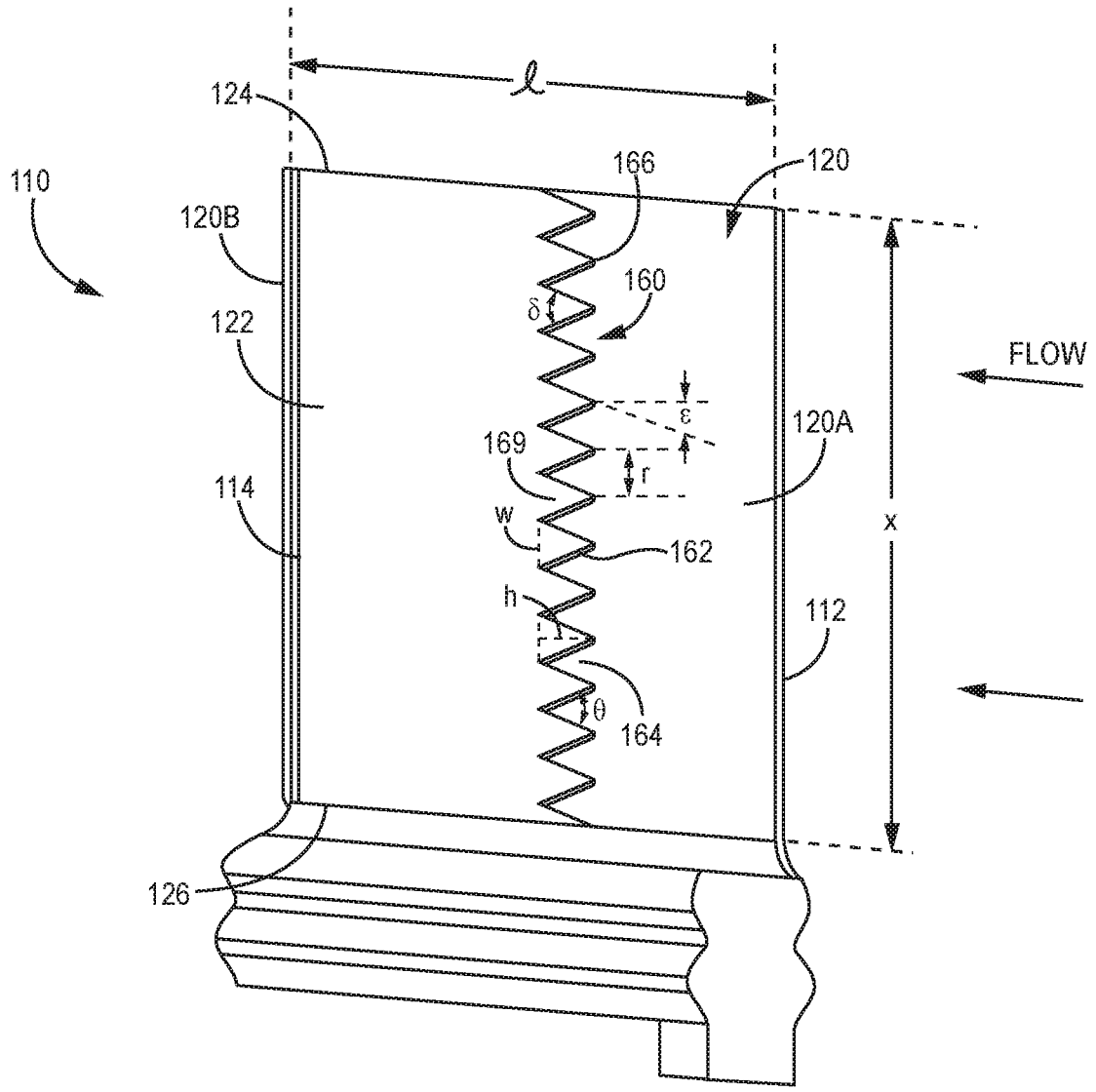
FIG. 2 is a schematic side view of an airfoil including an erosion-resistant coating including V-shaped grooves.
Figure 3:
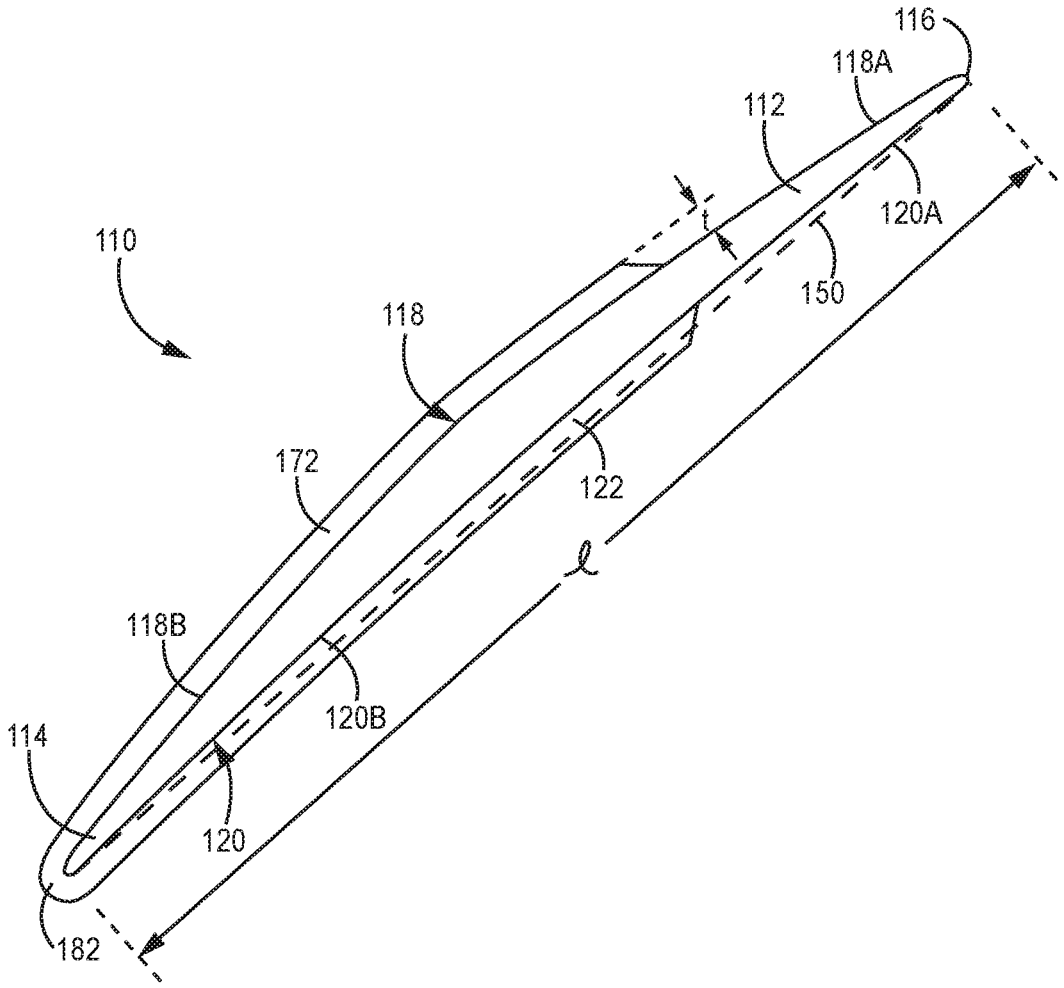
FIG. 3 is a schematic overhead view of the airfoil of FIG. 2.

Referring now to FIGS. 2-3, a schematic representation of an airfoil portion 110 includes a leading edge (LE) 112 and a trailing edge (TE) 114. The airfoil 110 further includes oppositely-disposed convex (suction) and concave (pressure) surfaces 118 and 120, a blade tip 124, and a root portion 126. The LE 114 is defined by a most forward point (nose) 116.

The airfoil 110 further includes a chord represented by the dashed line 150 between the LE 112 and the TE 114. The chord length l is a distance between the TE 114 and the point where the chord 150 intersects the LE 112.

The airfoil 110 is formed of a material that can be formed to the desired shape and withstand the necessary operating loads at the intended operating temperatures of the gas turbine compressor in which the airfoil 110 is installed. Suitable materials include metal alloys such as, for example, titanium, aluminum, cobalt, nickel, and steel-based alloys.

When the airfoil 110 is installed in a gas turbine engine, the convex (suction) and concave (pressure) surfaces 118 and 120 define flowpath surfaces that are directly exposed to the air drawn through the engine. The flowpath surfaces of the airfoil 110 are subject to impact erosion and abrasive erosion damage from particles entrained in the ingested air.

Abrasive erosion occurs when particles slide or graze along a surface, but with a high enough force that material erodes. Abrasive erosion is a primary cause of erosion in the blade tip where particles are caught between the blade tip and the blade track and are grinding the surfaces during compressor rotation. Traveling at relatively high velocities, particles strike the leading edge 114 or nose 116 at a near normal angle to the concave surface 120, such that impact with the nose 116 is head-on or nearly so. Because the airfoil 110 is typically formed of a metal alloy that is at least somewhat ductile, near normal impact erosion can deform the leading edge 114, forming burrs that can disturb and constrain airflow, degrade compressor efficiency, and reduce the fuel efficiency of the engine.

Erosion damage can be minimized, and aerodynamically favorable surface conditions better maintained, by applying an erosion-resistant coating to surfaces of the airfoil 110. The erosion-resistant coating may be entirely composed of one or more coating compositions, and may be bonded to the blade substrate with a metallic bond coat. In one example, which is not intended to be limiting, the coating may contain one or more layers of TiAlN, multiple layers of CrN and TiAlN in combination (for example, alternating layers), and one or more layers of TiSiCN, without any metallic interlayers between the layers. Such coatings preferably have a thickness t (FIG. 3) of about 5 microns to about 100 microns, or about 10 microns to about 75 microns. Coating thicknesses exceeding 100 microns are believed to be unnecessary in terms of protection, and undesirable in terms of additional weight. In another embodiment, the erosion coatings may include multi-layer erosion coatings which include alternating layers of a high hardness, erosion resistant materials and high ductility, fracture resistant materials such as, for example metals.

For example, if the coating is made up of TiAlN, the entire coating thickness can consist of a single layer of TiAlN or multiple layers of TiAlN, and each layer may have a thickness of about 5 microns to about 100 microns. In another example, if the coating is made up of multiple layers of CrN and TiAlN, each layer may have a thickness of about 0.2 to about 1.0 microns, or about 0.3 to about 0.6 microns, to yield a total coating thickness of at least about 5 microns. If the coating is made up of TiSiCN, the entire coating thickness can consist of a single layer of TiSiCN or multiple layers of TiSiCN, and each layer may have a thickness of about 5 microns to about 100 microns.

If a metallic bond coat is employed between the erosion-resistant coating and the metallic substrate material, the bond coat may be made up of one or more metal layers selected based on a composition of the metallic substrate material. For example, the metallic bond coat one or more layers of titanium and/or titanium aluminum alloys, including titanium aluminide intermetallics for a metallic substrate that includes a titanium alloy, may include a diffusion aluminide or an MCrAlY (where M is Ni, Co, or combinations thereof) for a metallic substrate that includes a nickel or cobalt alloy, or the like. The bond coat can be located entirely between the coating and the substrate it protects for the purpose of promoting adhesion of the coating to the substrate.

Erosion damage is primarily caused by glancing or oblique particle impacts on the concave surface 120 of the airfoil 110, and tends to be concentrated in an area forward of the TE 116, and secondarily in an area aft or beyond the LE 114. Such glancing impacts tend to remove material from the concave surface 120, especially near the TE 116. As noted above, the result is that the airfoil 110 gradually thins and loses its effective surface area due to loss in the chord length l, resulting in a decrease in compressor performance of the engine.

Referring again to FIGS. 2-3, the airfoil 110 includes a chord length l between the LE 112 and the TE 114, and a span length x along the concave surface 120 between the blade tip 124 and the root portion 126. The concave surface 120 includes a first portion 120A proximal the LE 112 of the airfoil 110 that is uncovered by, or free of, an erosion-resistant coating, and a second portion 120B proximal the TE of the airfoil 110 that is covered by an erosion-resistant coating 122. The first portion 120A includes about 10% to about 50% of the chord length l, or about 15% to about 40%, or about 20-30%.

The erosion-resistant coating 122 is applied over the second portion 120B of the concave surface 120 of the airfoil 110. The erosion-resistant coating includes a patterned leading edge 160 configured to enhance airflow over the concave surface 120. To most effectively enhance the aerodynamic performance of the concave surface 120, in various examples the erosion-resistant coating 122 overlying the second portion 120B occupies about 70% to about 100% of the span length x, as measured from the root portion 126.

The structures forming the patterned leading edge 160 of the erosion-resistant coating may vary widely, and may include any shape that controls the airflow over the edge of the erosion-resistant coating and reduces the potential for airflow separation that would be caused by airflow that encounters a straight wall-like edge. The structures forming the patterned leading edge 160 may be selected to further smooth air transitions over the leading edge 160 as the airfoil erodes, and in some examples have shapes selected to create vortex generation in a boundary layer of the air or other fluid flowing over the leading edge 160. Further, as the erosion-resistant coating wears away during operation of a turbine engine including the airfoil, in some examples the vortex generation can intensify, which can offset the aerodynamic effects of the increasing edge height of the erosion-resistant coating.

Figure 4:
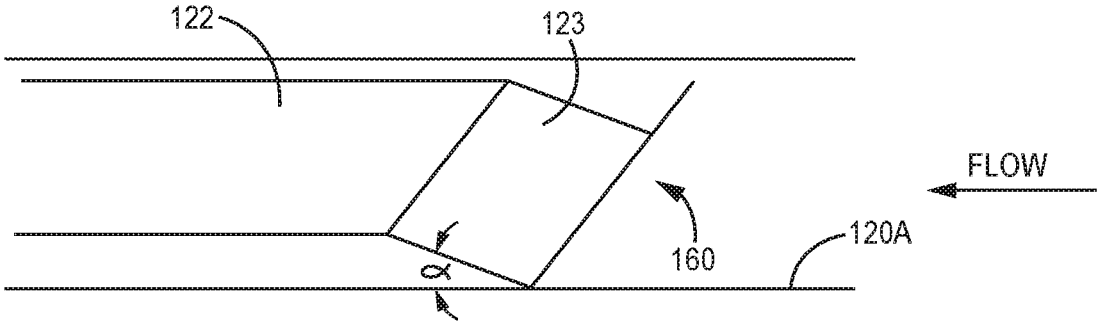
FIG. 4 is a schematic perspective view of a portion of a surface of an airfoil including an erosion-resistant coating.

For example, in one implementation, as shown in FIG. 4, the leading edge 160 of the erosion-resistant coating 122 incudes a shelf-like region 123 angled at an angle $\alpha$. In various examples, which are not intended to be limiting, the angle $\alpha$ can be up to about 150°, or about 45° to about 120°, or about 30° to about 45°, to smooth airflow over the leading edge of the coating.

Figure 5:
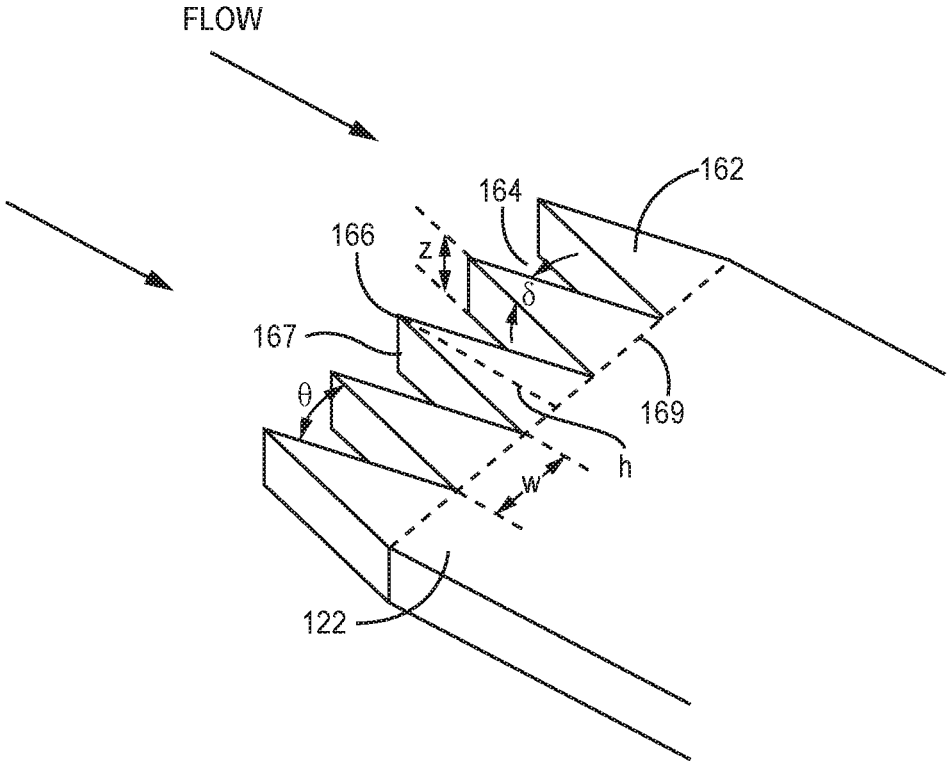
FIG. 5 is a schematic overhead perspective view of a portion of a surface of an airfoil including an erosion-resistant coating.

In another example shown in FIG. 2, and in more detail in FIG. 5, the leading edge 160 includes a corrugated arrangement of flow-directing pattern elements 162 configured to direct airflow over the erosion-resistant coating 122 and generate vortices at the leading edge 160, which energize the boundary layer and reduce potential for airflow separation. In various examples, the period and amplitude of the structures 162 can be optimized to have best effect on boundary layer and performance of the airfoil 110.

In the example of FIGS. 2 and 5, the leading edge 160 includes triangular prismatic pattern elements 162 separated by V-grooves 164. In various examples, the V-grooves 164 have an angle $\theta$ of about 30° to about 150°, or about 45° to about 120°. The triangular prismatic prism elements 162 have an apex 166 and leading edge 167 directed into the airflow over the concave surface 120A, and a base 169 that is generally wider than the apex 166. In in some examples the pattern elements 162 have an apex angle $\delta$ of about 30° to about 150°. In some examples, the pattern elements 162 have a base width w at their bases 169 of about 125 to about 2500 microns, and in various examples the pattern elements 162 have a period r of about 125 to about 2500 microns.

In some examples, the pattern elements 162 have an apex height h of about 125 to about 2500 microns, and the apexes 166 are set at a distance z above the concave surface 120A of about 5 microns to about 100 microns. In various examples, the pattern elements 162 can be oriented at a wide range of angles $\varepsilon$ of about 0° to about 60° with respect to the airflow direction over the concave surface.

Figure 6:
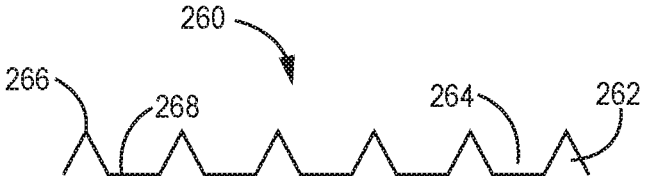
FIG. 6 is a schematic overhead view of a portion of a leading edge of an erosion-resistant coating including trapezoidal grooves.

In various examples, a wide variety of different corrugated patterns can be used on the patterned leading edge 160. The shapes of the alternating ridges and grooves can vary widely, and may include pattern elements 162 with sharp apexes that form a sawtooth-like pattern, or pattern elements with rounded apexes that form a sinusoidal-like pattern. In some examples as shown schematically in FIG. 6, a patterned leading edge 260 may include sharp or rounded pattern elements 262 separated by substantially flat land areas 268 such that the grooves 264 between pattern elements have a trapezoidal shape.

In various examples, the arrangement of pattern elements may be regular or irregular. For example, in some cases the pattern elements or grooves between pattern elements may have different shapes, different sizes in at least one dimension, different apex angles, different separations from one another, and the like, to form a desired pattern of symmetric or asymmetric vortices. In various examples, which are not intended to be limiting, the triangular prisms of FIGS. 2 and 5 can be oblique, or can include opposed bases of equilateral triangles or right triangles, or can have a varying depth between opposed bases thereof. In other examples, the triangular prisms can have a varying apex height h along the patterned leading edge 160.

In another example, only certain portions of the patterned leading edge 160 may include pattern elements, and some portions of the patterned leading edge may be free of pattern elements. Some portions of the patterned leading edge 160 can include an upwardly sloping shelf (FIG. 4), while other portions include pattern elements.

While the patterned erosion-resistant coatings discussed above are shown on the concave side 120 of the airfoil 110 (FIG. 3), in some examples, the airfoil 110 includes an erosion-resistant coating 182 that extends around the TE 114.

In some examples, the convex side 118 of the airfoil 110 is uncoated (free of an erosion-resistant coating), but in some cases the airfoil 110 can include an erosion-resistant coating 172 applied to the convex side 118 of the airfoil 120. In some examples, the erosion-resistant coating 172 includes a patterned coating leading edge configured to enhance airflow over the convex surface 118, and the erosion-resistant coating 172 may include any of the patterned coating leading edge designs discussed above. The erosion-resistant coating 172 may include the same leading edge pattern as applied to the concave side 120, or a different leading edge pattern.

In various examples, the convex surface 118 includes a first portion 118A proximal the LE 112 of the airfoil 110 that is uncovered by, or free of, an erosion-resistant coating, and a second portion 118B proximal the TE of the airfoil 110 that is covered by the erosion-resistant coating 172. The first portion 118A includes about 10% to about 90% of the chord length l, or about 15% to about 80%, or about 70%. To most effectively enhance the aerodynamic performance of the convex surface 118, in various examples the erosion-resistant coating 172 overlying the second portion 118B occupies about 70% to about 100% of the span length x of the convex surface 118 (not shown in FIG. 3).

The erosion-resistant coatings described herein may be deposited onto the bond coat or onto the metal substrate by a wide variety of techniques, and a physical vapor deposition (PVD) technique, which is carried out in vacuum, has been found to work well. The erosion-resistant coating deposited using PVD has a substantially columnar and/or dense microstructure, as opposed to the noncolumnar, irregular, and porous microstructure that would result if the coating were deposited by a thermal spray process such as HVOF. Particularly suitable PVD processes include EB-PVD, cathodic arc PVD, sputtering, and the like. Suitable sputtering techniques include, but are not limited to, direct current diode sputtering, radio frequency sputtering, ion beam sputtering, reactive sputtering, magnetron sputtering, plasma-enhanced magnetron sputtering, and steered arc sputtering. Cathodic arc PVD and plasma-enhanced magnetron sputtering are particularly preferred for producing coatings due to their high coating rates.

For the scenario where the entire surface of an airfoil is coated with the erosion-resistant coating, the airfoils are placed in the planetating fixtures of a vacuum chamber with no special efforts to control preferential coating thicknesses. For the preferentially deposited, patterned coatings, the same deposition parameters and planetating fixtures would be used, however, a mask would be used to prevent coating deposition on the airfoil in the unwanted areas.

In one example, the mask includes an adhesive-backed tape that has a corrugated edge shape and is applied to each airfoil on portions of the surfaces designed to be uncoated. As tape masks can in some cases be labor intensive to apply and remove, in another example the mask can include a hard tooling fixture that clamps onto one or both opposed surfaces of the airfoils prior to insertion of the airfoil into the planetating fixtures of the vacuum chamber. While hard tooling can be more expensive to make initially, since in some cases there are as many as 1000 blades to coat for each turbine engine, this approach can be most cost effective in the long run. A different hard tooling mask may be required for each different airfoil stage. The hard tooling would be manufactured to be conformal to the airfoil shape, at least in the area of the corrugated edge, where close contact to the airfoil can prevent the erosion resistant coating composition from going under the mask and depositing in unwanted areas of the airfoil surfaces.

Depending on the coating composition to be deposited, deposition can be carried out in an atmosphere containing a source of carbon (for example, methane), a source of nitrogen (for example, nitrogen gas), or a source of silicon and carbon (for example, trimethylsilane, $(CH_3)_3SiH$) to form carbide, silicon, and/or nitride constituents of the deposited erosion-resistant coating. The metallic bond coat and any other metallic layers are preferably deposited by performing the coating process in an inert atmosphere, for example, argon.

In various examples, which are not intended to be limiting, the erosion-resistant coating is preferably deposited to have a surface roughness which is equal to the underlying substrate roughness of about 0.25 micron or less, or about 0.13 micron or less, or about 0.10 micron or less. Polishing of the airfoil can be performed before coating deposition to promote the deposition of a smooth coating.

Various examples have been described. These and other examples are within the scope of the following claims.

What is claimed is:

1. An airfoil of a gas turbine engine, the airfoil comprising:

a leading edge and an opposed trailing edge, defining a chord between the leading edge and the trailing edge, wherein the chord has a chord length; and a concave surface between the leading edge and the trailing edge, the concave surface comprising a first portion proximal the leading edge of the airfoil and a second portion proximal the trailing edge of the airfoil, the first portion of the concave surface comprising 10% to 50% of the chord length; and an erosion-resistant ceramic, cermet or intermetallic coating on the second portion of the concave surface, the erosion-resistant coating comprising a leading edge pattern, wherein the leading edge pattern comprises an arrangement of vortex-generating pattern elements, and wherein the first portion of the concave surface is free of the erosion-resistant coating.

2. The airfoil of claim 1, wherein the airfoil comprises a blade tip surface and a root surface, and a span between the blade tip surface and the root surface, and wherein up to 30% of the span of the second portion of the concave surface is free of the erosion-resistant coating, as measured from a root portion of the airfoil.

3. The airfoil of claim 1, wherein the pattern elements have a leading edge and a base, wherein the coating leading edge is proximal the leading edge of the airfoil, and wherein a width of the leading edge is less than a width of the base.

4. The airfoil of claim 3, wherein the pattern elements are separated by V-grooves.

5. The airfoil of claim 3, wherein the pattern elements are separated by trapezoidal grooves.

6. The airfoil of claim 3, wherein the pattern elements comprise triangular prisms.

7. The airfoil of claim 6, wherein the triangular prisms are regular.

8. The airfoil of claim 1, wherein the leading edge pattern is a regular corrugated pattern.

9. The airfoil of claim 8, wherein the pattern comprises a sawtooth pattern.

10. The airfoil of claim 8, wherein the pattern comprises a sinusoidal pattern.

11. The airfoil of claim 1, further comprising a convex surface between the leading edge of the airfoil and the trailing edge of the airfoil, wherein the convex surface is opposite the concave surface, and wherein the convex surface is free of the erosion-resistant coating.

12. The airfoil of claim 11, wherein the convex surface comprises a first portion proximal the leading edge of the airfoil and a second portion proximal the trailing edge of the airfoil, the first portion of the convex surface comprising 10% to 90% of the chord length; and a second erosion-resistant coating on the second portion of the convex surface, wherein the first portion of the convex surface is free of the second erosion-resistant coating.

13. The airfoil of claim 12, wherein the second erosion-resistant coating on the convex surface of the airfoil comprises a patterned leading edge.

14. The airfoil of claim 13, wherein the patterned leading edge of the second erosion-resistant coating on the convex surface is substantially the same as the patterned leading edge of the erosion-resistant coating on the concave surface.

15. A method of making an airfoil for a gas turbine engine, the airfoil comprising a leading edge and an opposed trailing edge, and a chord between the leading edge and the trailing edge, wherein the chord has a chord length; a concave surface between the leading edge and the trailing edge, the concave surface comprising a first portion proximal the leading edge of the airfoil and a second portion proximal the trailing edge of the airfoil, the first portion of the concave surface comprising 10% to 50% of the chord length; the method comprising forming an erosion-resistant coating on the second portion of the concave surface, the erosion-resistant coating comprising a leading edge pattern, wherein the leading edge pattern comprises an arrangement of vortex-generating pattern elements, and wherein the first portion of the concave surface is free of the erosion-resistant coating.

16. The method of claim 15, wherein the erosion-resistant coating is formed by physical vapor deposition.

17. The method of claim 16, wherein the physical vapor deposition comprises a cathodic arc deposition.

18. The method of claim 15, wherein forming the erosion-resistant coating comprises placing a mask over the concave surface of the airfoil, and depositing an erosion-resistant coating composition over the mask onto the concave surface.

19. The method of claim 18, further comprising placing a mask over a convex surface of the airfoil, and depositing an erosion-resistant coating composition over the mask onto the convex surface.

* * * * *